US005078964A

United States Patent [19]

Arndt et al.

[11] Patent Number: 5,078,964

[45] Date of Patent: Jan. 7, 1992

[54] METHOD OF ALLOYING FEED MATERIAL INTO MOLTEN METAL

[75] Inventors: Eric D. Arndt, Lower Burrell; John M Urbanic, Churchill; Clark W. Keller, Leechburg; C. Ricardo Sammy, Murrysville, all of Pa.

[73] Assignee: Aluminum Company of America, Pittsburgh, Pa.

[21] Appl. No.: 615,131

[22] Filed: Nov. 19, 1990

[51] Int. Cl.[5] ..... C22C 1/00

[52] U.S. Cl. ..... 420/590; 75/560

[58] Field of Search ..... 75/560; 420/59

[56] References Cited

U.S. PATENT DOCUMENTS

| | | | |
|---|---|---|---|
| 3,467,167 | 9/1969 | Mahin | 75/560 |
| 4,688,771 | 8/1987 | Eckert et al. | 266/78 |
| 4,689,199 | 9/1987 | Eckert et al. | 420/590 |
| 4,784,832 | 11/1988 | Eckert et al. | 420/590 |
| 4,792,431 | 12/1988 | Eckert | 420/590 |
| 4,793,971 | 11/1988 | Eckert et al. | 420/590 |

*Primary Examiner*—Peter D. Rosenberg
*Attorney, Agent, or Firm*—David W. Pearce-Smith; Alfred D. Lobo

[57] ABSTRACT

A known "spark cup process" may be operated without the spark cup if the violent fluctuations in the melt surface with which the electric arc is struck are accommodated so as to allow the electric arc to be maintained substantially continuously. Controlling the dynamic profile of the melt surface without a spark cup allows continuous operation of the electric arc which generates enough plasma to permit addition of as much as 1000 lb/hr of a spray of superheated feed material to a flowing stream of melt which assimilates the feed material.

19 Claims, 2 Drawing Sheets

METHOD OF ALLOYING FEED MATERIAL INTO MOLTEN METAL

BACKGROUND OF THE INVENTION

Several processes have been disclosed for adding a feed material to a molten metal to form an alloy therewith, or to form an intermetallic compound. Such processes are referred to as "spark cup processes" because they convert the feed, e.g., lead, bismuth, tin, titanium, nickel, or other metal, into a superheated spray within a chamber or spark cup which is at least partially immersed in the molten metal.

The spark cup has a lower open end which is exposed to the molten metal and an upper inlet, which is located above the exposed or exterior surface of the molten metal. The lower open end of the spark cup is immersed to a predetermined depth below the surface of the molten metal. A wire is continually fed into the spark cup through its upper inlet. An electrical arc discharge, between the submerged molten metal surface and the end of the wire, is maintained with a current that exceeds the globular/spray transition current density of the feed wire. At such current, the free end of the feed wire is converted into a spray of superheated material which contacts and is alloyed into the molten metal.

Along with the feed wire, an ionizable gas is also continually supplied to the spark cup through its upper inlet. In addition to shielding the arc discharge, the gas slightly pressurizes the spark cup and prevents molten metal from entering its open end. As a result, the surface of molten metal within the spark cup is depressed relative to the surface of the molten metal outside the cup. The shielding gas also carries or projects the superheated spray of feed into the molten metal through the depressed surface so as to permit dissolution and dispersion of feed wire material into the molten metal. Depressing the melt surface within the cup relative to the surface of the molten metal outside the cup has been found to enhance significantly the dispersion and dissolution of the feed material into the molten metal. This prior art "spark cup" process is preferably used to make alloys of any molten metal, particularly of aluminum, and also to make intermetallic compounds such as $TiAl_3$ and $NiAl_3$. Further details of several spark cup processes are described in U.S. Pat. Nos. 4,688,771; 4,689,199; 4,784,832; 4,792,431 and 4,793,971, all issued to Eckert et al, the disclosures of which are incorporated by reference thereto as if fully set forth herein.

During the operation of the spark cup processes, the electric arc is so violent that molten metal frequently splashes up against its inner walls where it cools and solidifies. In a commercial operation, the coating of metal in the interior of the cup builds up to a point where it reduces the cross sectional area of the interior of the cup. The reduction of the interior of the cup makes the surface of the melt in the cup fluctuate out of control.

The prior art processes, therefore, focused on maintaining constant current with the expectation that the cup would provide a melt surface no more violent than a rippled one so that the complementary fluctuations in voltage would be tolerable. To the extent that the melt surface did not produce waves, as is the case when the feed rate is low and the amperage is correspondingly low, the spark process is acceptable because the cup life is not unexpectedly foreshortened.

The prior art spark cup process is not commercially acceptable at high feed rates and high current amperage because the spark cup is damaged with no forewarning, and the process must be stopped to replace the spark cup. The downtime associated with such interruptions are unacceptable in a production facility.

Moreover, the heat generated by the electric arc within the cup is such that, despite being made of boron nitride or other heat-tolerant ceramic material, the spark cup is damaged after a very short period of time. If the spark cup develops even a crack, it is unusable; the alloying process must be stopped until a replacement cup can be installed.

The unavoidable concomitant of the spark cup process is that the current requirement which is a function of feed rate, and the corresponding amount of heat generated (the $I^2R$ effect) is not only very large but also highly variable even over short intervals of time from about 0.1 second to 1 second.

In addition, there are pressure fluctuations within the spark cup. The fluctuations are the result of gas building up until a sufficiently high pressure is reached to cause a sudden escape of gas from under the cup. The gas escapes as a bubble and normally flows to the surface of the melt. The sudden release of gas is followed by another gradual pressure build-up.

Such fluctuations in gas pressure cause dynamic oscillations of the depressed melt surface within the cup. Such oscillations of the depressed melt surface, in turn, lead to dynamic oscillations of current transmitted. These dynamic oscillations result in such instability as to make the spark cup process very difficult to operate continuously. Though the apparent solution to the problem lay in stabilizing the process, it was not evident how such stabilization may be effected.

The present disclosure is a description of how this is accomplished.

SUMMARY OF THE INVENTION

It has been discovered that the "spark cup process" may be operated without the spark cup if the violent fluctuations in the depressed melt surface within the spark cup is accommodated sufficiently so that the electric arc may be maintained substantially continuously.

It has also been discovered that despite controlling the dynamic profile of the melt surface in a spark cup within the confines of its relatively small volume, a less controlled surface in a much larger volume allows continuous operation of an electric arc which generates enough plasma to permit addition of from 10 lb/hr to as much as 1000 lb/hr of feed material to a flowing stream of melt which assimilates the feed material.

It is, therefore, a general object of this invention to provide an alloying zone in a stream of flowing molten metal in a trough. The alloying zone is formed by upstream and downstream flow-restricting panels and a cover. The panels and the trough form the side walls of the chamber and the cover which rests upon the trough and the upper edges of the panels form a lid. The panels allow a continuous flow of the molten stream through the alloying zone and have through-passages near the bottom edges which allow for small amounts of gas to escape into the molten stream.

It has still further been discovered that the use of the through-passages near the bottom edges of the panels reduces the sporadic pulses or ∓burps" of gas. Continuous operation of the addition of metal in the form of a spray to the alloying zone can be obtained using an electric arc with constant voltage, with the current being limited.

It is, therefore, a general object of this invention to provide a process for continuously operating an alloying zone in a portion of a trough where the upper portion of a stream of molten metal is dammed by providing a current density in the range of from about 25,000 to 140,000 amps/in$^2$ at constant voltage to feed material fed in plasma-generating relationship with a melt surface. This melt surface is depressed relative to the surface of the stream, while relieving inert gas under pressure within the alloying zone.

It is a specific object of this invention to provide a process for alloying a feed material with a molten metal comprising: (a) continuously flowing a stream of molten metal through an alloying zone separated from the flowing stream but in open flow communication therewith, the alloying zone having opposed longitudinally spaced-apart upstream and downstream boundaries which intersect said stream's cross section and side boundaries of the stream; (b) maintaining a shielding zone sealed against leakage of reactive gas, the shielding zone contiguously overlying the alloying zone and coextensive therewith; (c) flowing an ionizable gas, unreactive with the feed material and the molten metal, into the shielding zone in a sufficient volume and under sufficient pressure to displace essentially all reactive gas therein, and to depress the surface of molten metal within the alloying zone to provide a depressed surface below the surface of the stream; (d) feeding the feed material as an elongate mass through the shielding zone to position one end of said elongate mass in plasma-generating relationship with melt in the alloying zone; (e) passing sufficient current at substantially constant voltage through the feed material to generate a spray of melt particles; and (f) introducing the feed material in spray-coated profusion onto the surface for dispersion into the molten metal, whereby operation of the process is substantially continuous.

It is also a specific object of this invention to provide a process for forming one or more intermetallic compounds with a feed material, in a manner analogous to that described hereinabove, except of course that the alloying zone is a zone in which the intermetallic compounds formed are assimilated in the melt flowing through the zone.

It is another specific object of this invention to provide a system for assimilating a feed material into a molten metal, the system comprising: (a) a portion of a trough in which the upper portion of a stream of flowing molten metal is dammed by longitudinally spaced apart upstream and downstream panels which provide a passage for flow of the molten metal along the bottom of the trough and an alloying zone between the panels; (b) means for supplying a feed material for assimilation into the alloying zone; (c) means for supplying current at constant voltage but under current limiting conditions to maintain an electric arc in plasma-generating relationship with the molten metal in the alloying zone; (d) means for supplying a substantially constant mass flow of an inert gas under sufficient pressure to depress the surface of molten metal in the alloying zone relative to the stream surface outside the alloying zone, the flow of gas being codirectional with the direction of advancing feed material to direct it toward the molten metal, and the mass flow being controlled to provide gas build-up above the alloying zone in which pressure is relieved by escape of a controlled amount of the gas.

BRIEF DESCRIPTION OF THE DRAWINGS

The foregoing and other objects of our invention will appear more fully from the following description, made in connection with the accompanying drawings of preferred embodiments of the invention, in which.

DETAILED DESCRIPTION OF PREFERRED EMBODIMENTS

Feed material to be alloyed, or to be converted to an intermetallic compound, is fed as a wire, rod or other elongate mass, through a sealed shielding zone, so as to maintain the end of the wire in plasma-generating relationship with the depressed surface in the alloying zone. Meanwhile, an ionizable gas unreactive with the feed material is flowed around the wire to shield it in a shielding zone which lies above the contiguous alloying zone. The flow of ionizable gas into the shielding zone is under sufficient pressure so that the depressed surface in the alloying zone is depressed below that of the stream surface, both upstream and downstream of the alloying zone, and the shielding zone is sealed against leakage of a reactive gas into it.

Typically, the end of the wire of feed material is also below the stream surface, and the flow of ionizable gas is downward towards the melt surface. Enough direct current, exceeding the globular/spray transition current density of the feed, at substantially constant voltage, but current limited is flowed to the free end of the wire to generate plasma, resulting in the formation of a spray of microscopic particles of molten metal. These particles are blown onto the depressed surface and become assimilated into the stream.

To harness the energy in the plasma and effectively direct it towards forming a microscopic or submicroscopic spray of submicron size melt particles, the prior art confined the plasma in the spark cup. The result was that the dynamic oscillations of the depressed surface were difficult to control, molten metal was splashed against the inside surfaces of the cup, making it difficult to feed the wire past the metal plugging the cup. Eventually, the intensity of heat generated within the spark cup damaged it. Since there is no spark cup means used in the subject process and nothing but the damming panels immersed in the stream of molten metal, there is nothing to be damaged upon being overheated, and the large volume of the portion of the trough used to provide the alloying zone precludes plugging the inlet for the feed wire.

Figure 1:
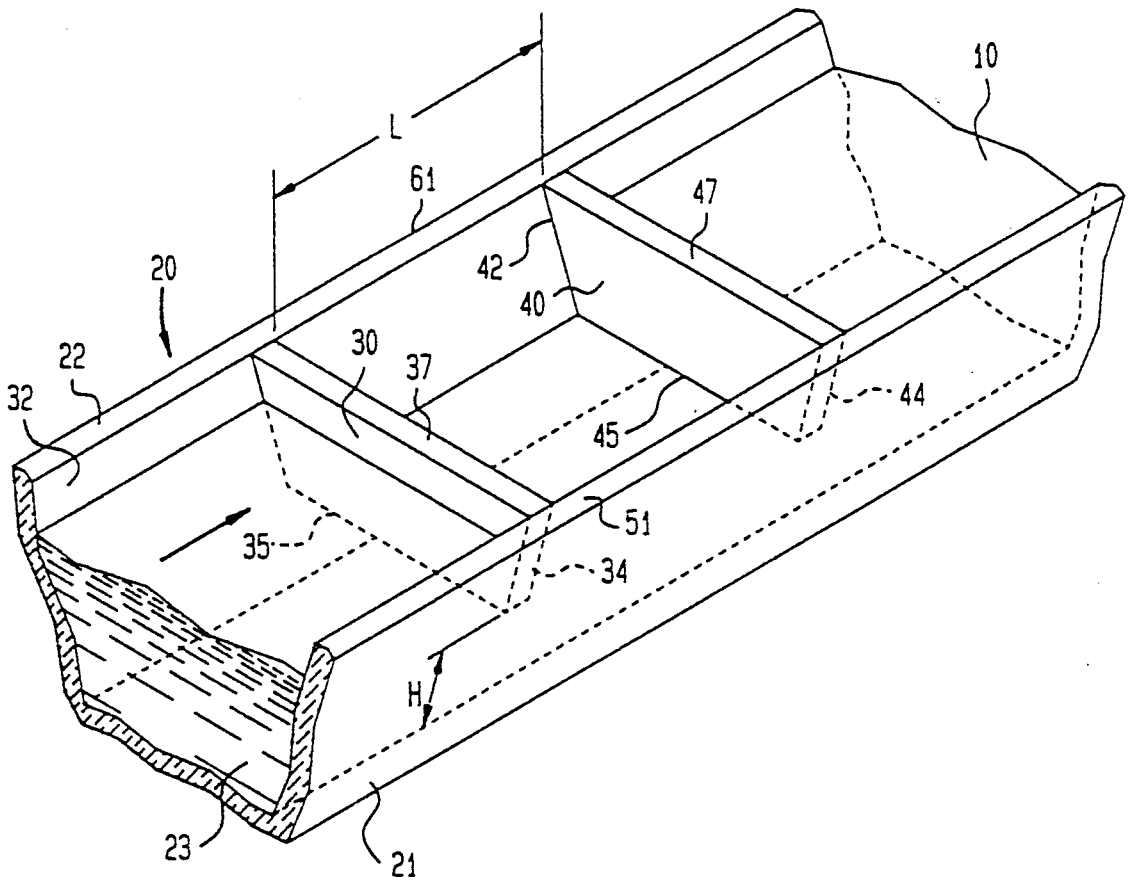
FIG. 1 illustrates an elevational perspective view, with portions broken away, the cover removed, and without the feed mechanism, of a cupless alloying zone formed by damming the upper portion of a stream of molten metal flowing in a trough having a generally trapezoidal cross section.
Figure 2:
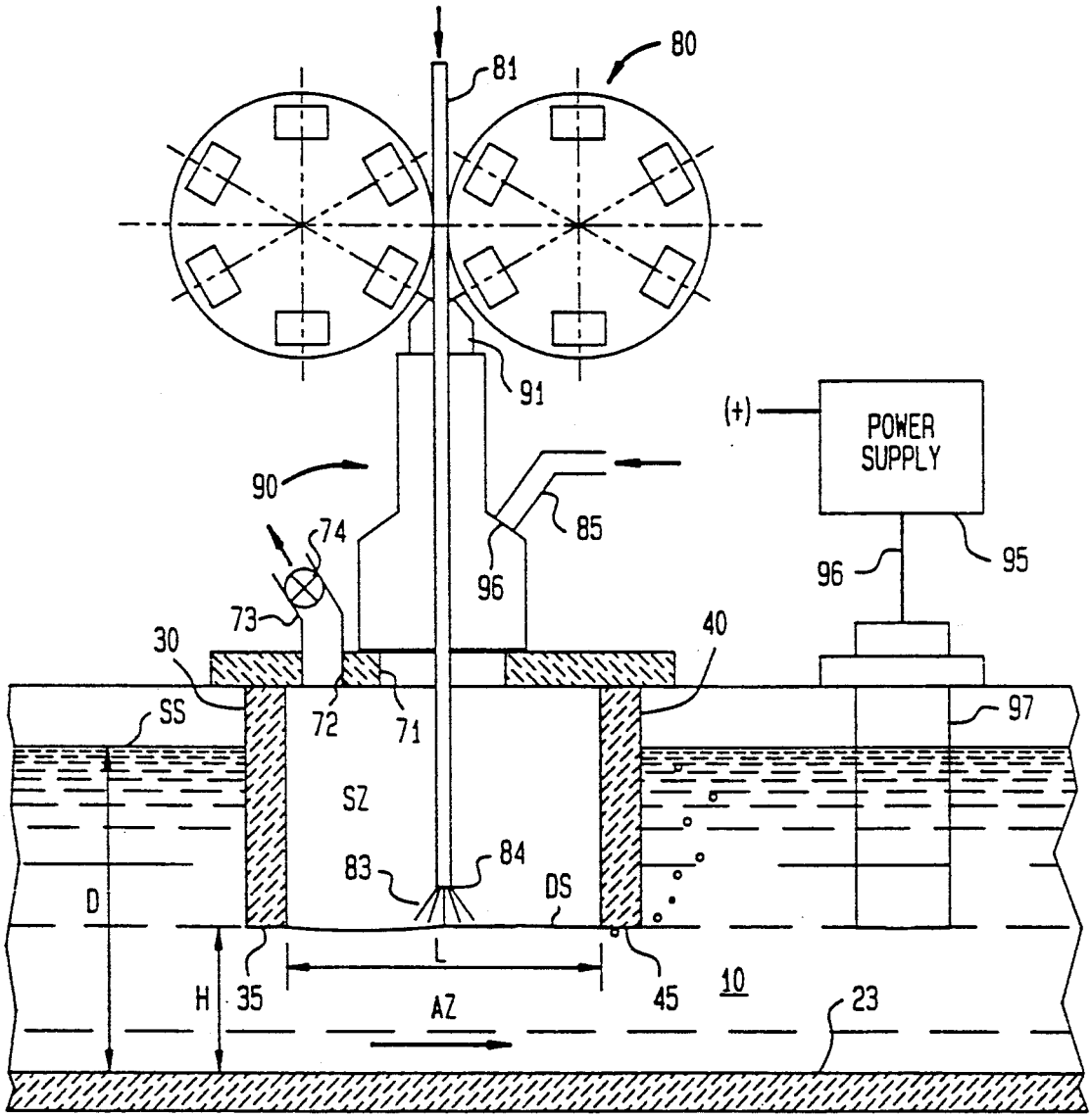
FIG. 2 is a side elevational view of a cupless alloying zone formed by damming the upper portion of a stream of molten metal flowing in a trough having a generally trapezoidal cross section and associated apparatus.

Referring to FIGS. 1 and 2, there is schematically illustrated the manner in which a stream of molten metal 10, e.g., aluminum, flowing in a trapezoidal trough, referred to generally by reference numeral 20. Trough 20 is dammed by upstream and downstream panels 30 and 40, respectively, longitudinally spaced apart relative to each other by distance 'L'. Opposed conveying side edges 32 and 34 of panel 30, and opposed converging side edges 42 and 44 of panel 40 are fitted in fluid-tight relation against the sides 22 and 21, respectively, of the trough; edges 32 and 42 against side 22, and edges 34 and 44 against side 21, so that the upper portion of the flowing stream is dammed. The bottom edges 35 and 45 of the panels 30 and 40 are raised; that is, vertically spaced apart from the bottom 23 of the trough by height 'H' (shown more clearly in FIG. 2).

Alloying commences when superheated metal spray contacts and is dispersed in molten metal in the alloying zone AZ (shown in FIG. 2) directly beneath the depressed surface DS (shown in FIG. 2) of melt 10 and bounded by the sides of the trough 20 and the opposed bottom edges 35 and 45 of the panels 30 and 40. The portion of the trough to be used for the alloying zone is preferably made of refractory material resistant to thermal shock and inert relative to the molten metal because they are exposed to extreme heat above the alloying zone AZ. The upper edges 37 and 47 of the side panels 30 and 40, and the upper edges 51 and 61 of the fore and aft sides 21 and 22 of the trough are coplanar so as to present a rectangular frame upon which a cover 70 (see FIG. 2) is secured in gas-tight relationship with respect to edges 37 and 47 of panels 30 and 40 and edges 51 and 61 of sides 21 and 22 of the trough.

Referring further to FIG. 2 in which the apparatus for continuously feeding a metal wire 81 is schematically illustrated, the stream surface SS of molten metal 10 has an average depth D outside the alloying zone AZ. The wire feed 81 is fed into a shielding zone SZ by a feeder 80 which feeds the wire 81 through a tightly fitting grommet means 91 in a housing 90 sealingly fitted over a passage 71 in the cover 70 to prevent leakage of reactive gas. The shielding zone SZ is generally the interior volume formed by panels 30 and 40, cover 70 and depressed surface DS. Shielding zone SZ lies above and contiguously coextends over the alloying zone AZ.

Shielding gas preferably helium or argon, is flowed through gas line 85 from a source of gas, such as a gas cylinder (not shown), and the gas enters housing 90 through inlet port 96. The wire is converted into a spray 83 of superheated metal by passing the wire through a plasma arc discharge (not numbered) having a core temperature which far exceeds the melting point of the feed. The plasma arc discharge is established between depressed surface DS of molten metal in the alloying zone and the free end 84 of wire 80.

The depressed surface DS is depressed by pressure exerted by the shielding gas for reasons explained in greater detail in the aforementioned Eckert et al patents. The pressure of the gas depends upon the density of the flowing melt, the depth to which DS is to be depressed, the desired average frequency of pulsing of escaping gas and related factors. A typical pressure in the shielding zone SZ is in the range of from about 1 inch of water to about 1 psig, the preferred pressure with molten aluminum being in the range from about 5 to 15 inches of water. The mass flow of inert shielding gas is sufficient to shield the wire as it enters the shielding zone SZ and also while molten metal flows under and past it. In addition, the pressure of the inert gas is such as to allow a build-up of pressure above the alloying zone AZ until it is suddenly released in a sporadic pulse from under the bottom edges 35 and 45 of the upstream and downstream damming panels, through the melt to the stream surface SS.

As will be appreciated, the pulsed release of gas from under the panels, to relieve pressure in the shielding zone, results in a turbulent surface DS having large fluctuations. To decrease these fluctuations, it is sometimes desirable to provide for escape of the shielding gas from above depressed surface DS. This is done by providing a passage 72 in the cover 70, with a relief conduit 73 fitted in the passage 72. The conduit 73 is provided with a relief valve 74 which may be set to provide escape of the desired amount of gas.

Thus, escape of the excess shielding gas may be either from under the panels or through the relief conduit 73, or both in combination in such a manner as to provide a desirably dynamic depressed surface DS, even if it is never quiescent.

The arc discharge is powered by a constant voltage power supply source 95 which is current limited. Melt in the alloying zone AZ serves as an anode with wire 81 serving as a consumable electrode. The electrical circuit leading back to current power supply source 95 is completed by a return wire 96 which is attached to rod 97 immersed in the stream 10.

The superheated spray 83 produced by the arc discharge is directed or projected downward by the downflow of inert gas, and the depressed surface DS is profusely spray-coated with the feed material which is then dispersed in the melt. The gas is preferably supplied at a flow rate which maximizes the projection of spray onto the surface of the melt in alloying zone AZ and minimizes splatter onto the interior surfaces of panels 30 and 40 and the portions of sides 51 and 61 of trough 20 that form shielding zone SZ. The spray 83 is continuously maintained by progressively advancing the wire so as to maintain the distance from the melt surface which supports the plasma-generating arc. The rate at which the wire 81 is fed to the alloying zone AZ may be varied depending upon the flow rate of the stream through the alloying zone AZ, the cross-sectional area of feed wire 81 and the power used.

The form in which the elongate mass of feed material is fed into the shielding zone SZ is not narrowly critical and may be in the form of rod, wire or strip of sheet material, as just stated; as a tube or strip; in powdered form if the powder is compacted within a tube of suitable metal; or even as a melt.

The constant voltage source of current being current limited produces an arc with self-stabilizing characteristics which desensitizes plasma generation to arc geometry which varies with fluctuations of the depressed surface DS. It may also be desirable to use various fluxes or to seed the plasma discharge with certain additives, such as alkali metals which are known to promote arc stability.

The current supplied by power source 95 exceeds the globular/spray transition current density of the feed. As used herein, the globular/spray transition current density defines the boundary line separating two different types of metal transfer which may occur in the plasma arc discharge. A current density below the transition point generates a coarse spray of large drops which dissolve and disperse relatively slowly in the melt. A current density above the transition point generates a fine spray of superheated microscopic droplets which dissolve and disperse relatively quickly in the melt.

The panels 30 and 40, as well as the cover 70, are preferably made of a ceramic or other refractory material, for example, boron nitride, borosilicate, alumina, mullite, silica and the like, commercially available, Marinite board being most preferred. If an existing metal trough is to be used, its fore and aft sides may need to be protected with refractory material. The large volume surrounding the arc discharge facilitates the absorption and dissipation of heat, most of which is transferred to the melt with the result that alloying of the feed, or assimilation of intermetallic compounds formed, is accelerated.

In a manner analogous to that described hereinabove for alloying a feed material such as a single metal, for example, lead, with aluminum, intermetallic compounds may be formed and dispersed into a flowing melt. Geometrically close-packed (GCP) or topographically close-packed intermetallic particles such as $TiAl_3$, $NiAl_3$ and other particles, may be formed in the process of this invention to reinforce, strengthen or otherwise enhance a metal matrix such as aluminum. It will be understood that the term "alloying zone" is used for convenience, to define the zone in which incorporation of the intermetallic compounds into the melt occurs, though the intermetallic compounds are simply assimilated in the melt and no alloy of melt and intermetallic compound is formed.

The process for forming one or more intermetallic compounds with a feed material comprises continuously flowing a stream of molten metal through an alloying zone separated from the flowing stream but in open flow communication therewith; maintaining a shielding zone sealed against leakage of reactive gas, the shielding zone contiguously overlying the alloying zone and coextensive therewith; flowing an ionizable gas, unreactive with the feed material and the molten metal, into the shielding zone in a sufficient volume and under sufficient pressure to displace essentially all reactive gas therein, and to depress the surface of molten metal within the alloying zone to provide a depressed surface below the surface of the stream; feeding the feed material comprising one or more vaporizable metallic constituents reactive above vaporization temperature, as an elongate mass through the shielding zone to position one end of the elongate mass in plasma-generating relationship with melt in the alloying zone; passing sufficient current at substantially constant voltage but current limited, through the feed material to generate one or more intermetallic compounds in a spray of melt particles; and introducing the intermetallic compounds in spray-coated profusion onto the surface for dispersion into the molten metal.

For example, a titanium rod fed through the shielding zone to generate a plasma produces a spray of titanium which reacts with the aluminum melt to form titanium aluminide. Numerous intermetallic compounds may be formed by employing one metallic component as a solid rod, the other being provided in a molten fluent state. Examples of intermetallic compounds which may be formed are $Ni_3Al$, $FeAl_3$ and $VAl_3$ using a molten aluminum stream and rods of Ni, Fe and V, respectively; $W_2Fe_3$, $CeFe_5$ and $FeAl_3$ using molten iron and rods of W, Ce and Al, respectively; $CrNi_3$ and $MnNi_3$ using molten nickel and rods of Cr and Mn, respectively; inter alia. Details for formation of other intermetallic compounds and the vaporization temperatures for various metals are provided in the aforementioned '431 patent, column 7, et seq.

The yield of intermetallic compound particles is increased by increasing the rat of addition of metal rod and the mass flow of molten metal in the trough. The volume fraction of intermetallic particles is in the range of from 10% to about 30% or more.

In many instances, the intermetallic particles are retained in the molten metal to reinforce the metal and imbue it with distinguishing physical properties. If desired, however, the intermetallic particles may be separated from the molten metal by filtering or centrifuging the molten metal stream in which the particles are dispersed. The particles so recovered form an occluded mass. For example, particles of nickel aluminide are recovered from a molten aluminum stream as a mass of particles with occluded aluminum. If not used as such, and it is desired to recover the particles without the aluminum, the aluminum may be dissolved with sodium hydroxide without affecting the nickel aluminide particles.

It will be apparent to those skilled in the relevant art that various changes and modifications may be made in the embodiments described above to achieve the same or equivalent results without departing from the principles of the present invention as described and claimed herein. All such changes and modifications are intended to be covered by the following claims.

What is claimed is:

1. A process for alloying a feed material with a molten metal comprising:

(a) continuously flowing a stream of molten metal through an alloying zone separated from said flowing stream but in open flow communication therewith, said alloying zone having opposed longitudinally spaced-apart upstream and downstream boundaries which intersect said stream's cross section and side boundaries which coincide with fore and aft boundaries of said stream;

(b) maintaining a shielding zone sealed against leakage of reactive gas, said shielding zone contiguously overlying said alloying zone and coextensive therewith;

(c) flowing an ionizable gas, unreactive with said feed material and said molten metal, into said shielding zone in a sufficient volume and under sufficient pressure to displace essentially all reactive gas therein, and to depress the surface of molten metal within said alloying zone to provide a depressed surface below the surface of said stream;

(d) feeding said feed material as an elongate mass through said shielding zone to position one end of said elongate mass in plasma-generating relationship with melt in said alloying zone;

(e) passing sufficient current at substantially constant voltage and current limiting conditions through said feed material to generate a spray of melt particles; and (f) introducing said feed material in spray-coated profusion onto said surface for dispersion into said molten metal.

2. The process of claim 1 comprising in step (d), feeding said feed material as a substantially continuous rod or wire through which current is conducted.

3. The process of claim 1 comprising in step (c), flowing said ionizable gas at a rate sufficient to boost assimilation of said spray into said alloying zone.

4. The process of claim 1 wherein said molten metal of said stream is aluminum or an alloy thereof and said feed material is another metal.

5. The process of claim 1 wherein said ionizable gas is selected from the group consisting of argon, neon, xenon, helium, carbon monoxide and carbon dioxide.

6. The process of claim 1 wherein the major portion of heat generated by said current is transferred to said molten metal within said alloying zone.

7. The process of claim 1 wherein the major portion by weight of said feed material is alloyed in said molten metal.

8. The process of claim 7 wherein said molten metal is aluminum, said ionizable gas is selected from the group consisting of argon and helium and said reactive gas is oxygen.

9. The process of claim 8 wherein said ionizable gas is helium.

10. The process of claim 6 wherein step (d) includes flowing said inert gas codirectionally with advancing feed material to direct said gas and spray of metal particles toward the molten metal, the mass flow of inert gas being controlled to provide a gas build-up above the alloying zone in which pressure is relieved by escape of gas.

11. A process for forming one or more intermetallic compounds with a feed material comprising:

(a) continuously flowing a stream of molten metal through an alloying zone separated from said flowing stream but in open flow communication therewith, said alloying zone having opposed longitudinally spaced-apart upstream and downstream boundaries which intersect said stream's cross section and side boundaries which coincide with fore and aft boundaries of said stream;

(b) maintaining a shielding zone sealed against leakage of reactive gas, said shielding zone contiguously overlying said alloying zone and coextensive therewith;

(c) flowing an ionizable gas, unreactive with said feed material and said molten metal, into said shielding zone in a sufficient volume and under sufficient pressure to displace essentially all reactive gas therein, and to depress the surface of molten metal within said alloying zone to provide a depressed surface below the surface of said stream;

(d) feeding said feed material comprising one or more vaporizable metallic constituents reactive above vaporization temperature as an elongate mass through said shielding zone to position one end of said elongate mass in plasma-generating relationship with melt in said alloying zone;

(e) passing sufficient current at substantially constant voltage and current limiting conditions through said feed material to generate one or more intermetallic compounds in a spray of melt particles; and (f) introducing said intermetallic compounds in spray-coated profusion onto said surface for dispersion into said molten metal.

12. The process of claim 11 comprising in step (d), feeding said feed material as an elongate mass to position said one end below the surface of said stream.

13. The process of claim 11 wherein said molten metal of said stream is aluminum or an alloy thereof and said feed material is another metal.

14. The process of claim 11 wherein said ionizable gas is selected from the group consisting of argon, neon, xenon, helium, carbon monoxide and carbon dioxide.

15. The process of claim 11 wherein the major portion of heat generated by said current is transferred to said molten metal within said alloying zone.

16. A system for assimilating a feed material into a molten metal, the system comprising:

(a) a portion of a trough in which the upper portion of a stream of flowing molten metal is dammed by longitudinally spaced apart upstream and downstream panels which provide a passage for flow of the molten metal along the bottom of the trough and an alloying zone between the panels;

(b) cover means interconnecting said panels and the sides of said trough to form a gas-tight shielding zone above said alloying zone;

(c) means for supplying a feed material for assimilation into the alloying zone;

(d) means for supplying current at constant voltage but under current limiting conditions to maintain an electric arc in plasma-generating relationship with the molten metal in the alloying zone; and (e) means for supplying a substantially constant mass flow of an inert gas under sufficient pressure to depress the surface of molten metal in the alloying zone relative to the stream surface outside the alloying zone, the flow of gas being codirectional with the direction of advancing feed material to direct it toward the molten metal, and the mass flow being controlled to provide gas build-up in said shielding zone in which pressure is controllably relieved by escape of gas.

17. The system of claim 16 wherein said means for supplying current supplies sufficient current to provide a current density in the range of from about 25,000 amps/in$^2$ to about 140,000 amps/in$^2$.

18. The system of claim 17 wherein said molten metal is aluminum or an alloy thereof, said feed material is another metal, and when said feed material is assimilated, it forms an alloy with said molten metal.

19. The system of claim 17 wherein said molten metal is selected from the group consisting of aluminum, iron and nickel, said feed material is another metal, and said feed material forms an intermetallic compound which is assimilated in said molten metal.

* * * * *